United States Patent [19]

DeWan

[11] Patent Number: 4,944,042

[45] Date of Patent: Jul. 31, 1990

[54] ARTICLE WITH CONTAINER-FORMING PORTION

[76] Inventor: Thomas E. DeWan, 5945 Carrier St., St. Petersburg, Fla. 33714

[21] Appl. No.: 325,518

[22] Filed: Mar. 17, 1989

[51] Int. Cl.[5] ..... A41D 3/02

[52] U.S. Cl. ..... 2/94; 2/85; 2/93; 190/1

[58] Field of Search ..... 2/1, 69, 69.5, 72, 79, 2/85, 86, 93, 94, 115, 125, 227, 301; 190/1, 13 R, 14, 15.1

[56] References Cited

U.S. PATENT DOCUMENTS

| | | | |
|---|---|---|---|
| 2,058,474 | 10/1936 | Long | 2/85 |
| 2,146,243 | 2/1939 | Aug | 2/85 |
| 2,292,347 | 8/1942 | Bailey | 2/93 |
| 2,324,722 | 7/1943 | Papierniak | 2/93 |
| 2,325,494 | 7/1943 | Fayer | 2/93 |
| 4,404,687 | 9/1983 | Hager | 2/94 |
| 4,404,689 | 9/1983 | DeWan | 2/94 |
| 4,475,251 | 10/1984 | Hopkins | 2/94 |
| 4,476,587 | 10/1984 | Itoi | 2/94 |
| 4,502,155 | 3/1985 | Itoi | 2/94 |
| 4,555,812 | 12/1985 | Akers | 2/94 |
| 4,689,831 | 9/1987 | Greenberger | 2/93 |

FOREIGN PATENT DOCUMENTS

| | | | |
|---|---|---|---|
| 2365933 | 9/1976 | France | 2/94 |
| 2500275 | 8/1982 | France | 2/93 |
| 1561459 | 2/1980 | United Kingdom | 2/94 |

*Primary Examiner*—Werner H. Schroeder
*Assistant Examiner*—Diana L. Biefeld
*Attorney, Agent, or Firm*—Senniger, Powers, Leavitt and Roedel

[57] ABSTRACT

An article of flexible material having a tubular portion which is functional during normal use of the article and which forms a container for the article when the article is not in use. The container-forming portion has first and second opposite ends, at least one end defining a mouth through which the article, when not in use, may be stuffed into the container-forming portion, a first closure carried by the article for at least partially closing the first end of the container-forming portion, and a second closure carried by the article for at least partially closing the second end of the container-forming portion whereby, with the article stuffed in the container-forming portion and both ends of the container-forming portion at least partially closed, the article is releasably held in the container-forming portion.

26 Claims, 4 Drawing Sheets

FIG. 1.
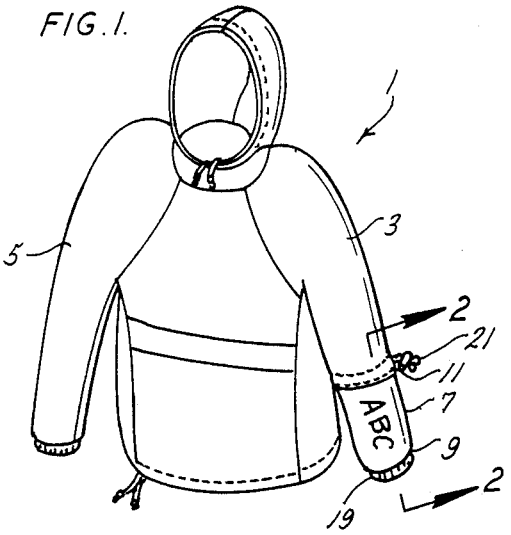
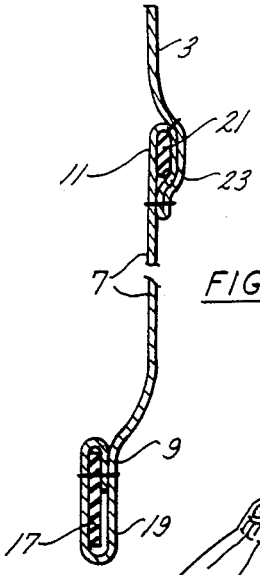
FIG. 2.
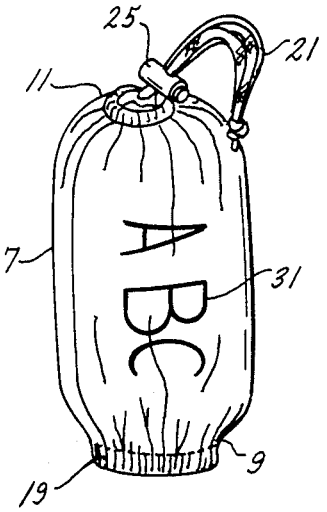
FIG. 4.
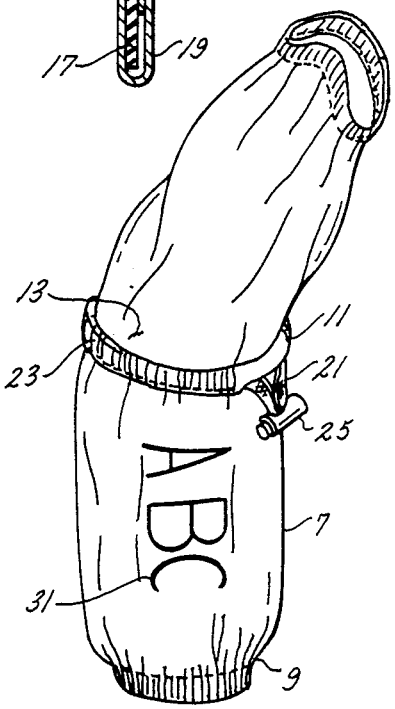
FIG. 3.

FIG. 5.
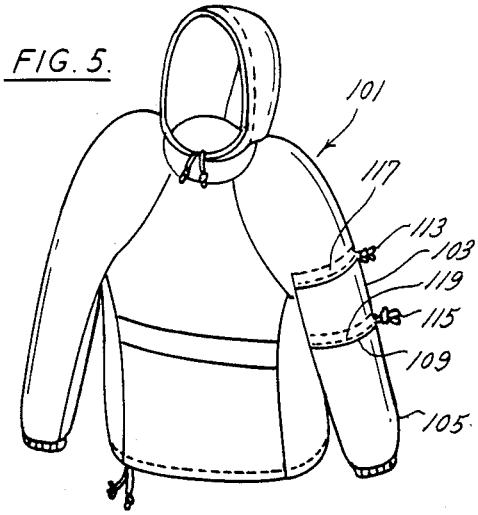
FIG. 6.
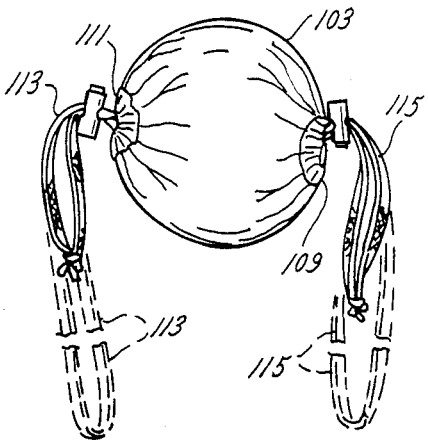
FIG. 7.
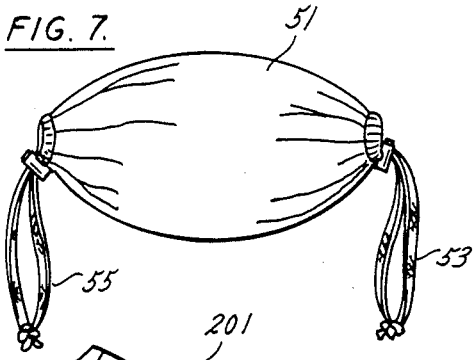
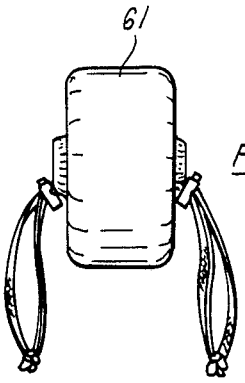
FIG. 8.
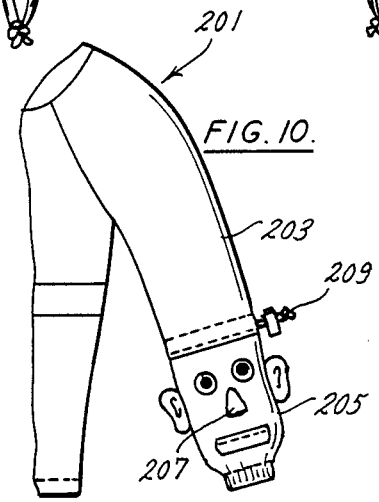
FIG. 10.
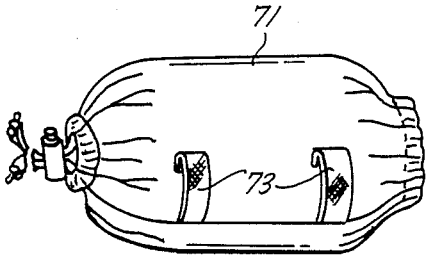
FIG. 9.

FIG. 11.
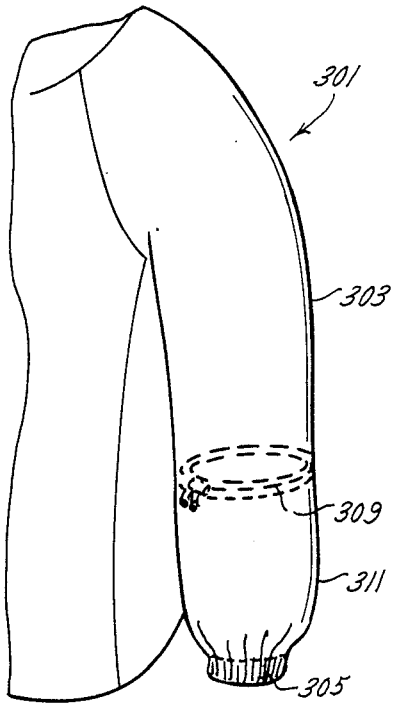
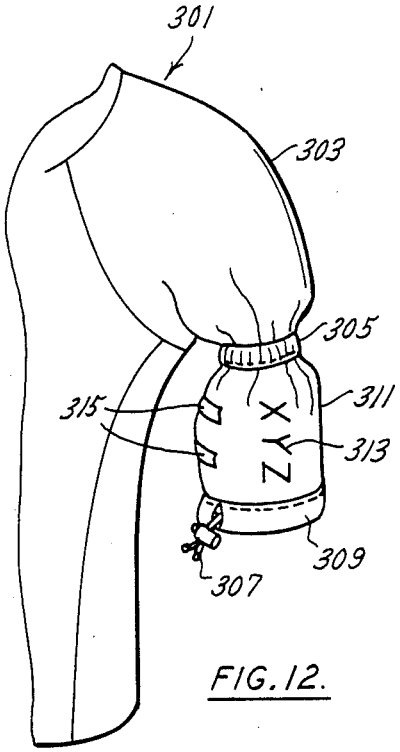
FIG. 12.
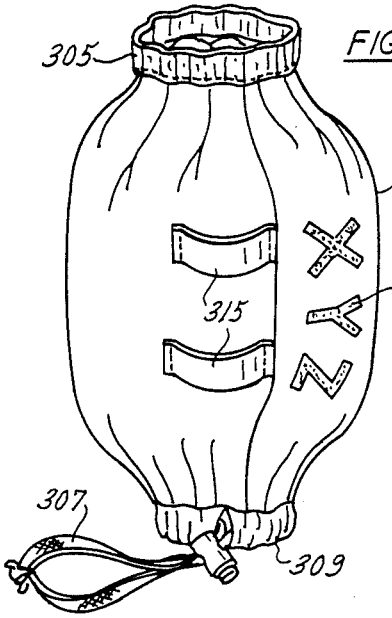
FIG. 13.

ARTICLE WITH CONTAINER-FORMING PORTION

BACKGROUND OF THE INVENTION

This invention relates generally to the storage and transport of articles.

Articles such as garments and duffel bags are often quite bulky, so that storage and/or transport of the article when not in use may be burdensome. Garments, for example, are typically carried in suitcases, knapsacks and other types of containers which are cumbersome to use and which, when not in use, must be stored.

SUMMARY OF THE INVENTION

Among the several objects of this invention may be noted the provision of an article such as a garment or bag having a tubular portion which is functional in the normal use of the article and which also functions as a container for the article when the article is not in use; the provision of such an article having a container-forming portion which may be imprinted with indicia (e.g., advertising) for display during ordinary use of the article and/or while the article is stored inside the container-forming portion; the provision of such an article which may be a garment (e.g., T-shirt, sweatshirt, sweat suit, jacket, trousers, coat, shirt, sweater, leotards, sleepwear and lingerie) having a sleeve and/or a leg, or a bag such as a duffel bag; the provision of such an article which is adapted to be readily carried; the provision of such an article wherein the container-forming portion of the article may be configured to assume a desired shape (e.g., a round ball, a football, a tire or doughnut, a bottle, fruits, vegetables, etc.) when it contains the article; and the provision of such an article which is simple in design for economical manufacture.

Briefly, this invention involves an article of flexible material having a tubular portion which is functional during normal use of the article and which is adapted to form a container for the article when the article is not in use. The container-forming portion has first and second opposite ends, at least one end defining a mouth through which the article, when not in use, may be stuffed into the container-forming portion, first means carried by the article for at least partially closing the first end of the container-forming portion, and second means carried by the article for at least partially closing the second end of the container-forming portion whereby, with the article stuffed in the container-forming portion and both ends of the container-forming portion at least partially closed, the article is releasably held in the container-forming portion.

Other objects and features will be in part apparent and in part pointed out hereinafter.

BRIEF DESCRIPTION OF THE DRAWINGS

FIG. 1 is a perspective of a garment having a sleeve a portion of which is adapted to form a container for the garment when the garment is not in use;

FIG. 2 is an enlarged section on line 2—2 of FIG. 1;

FIG. 3 is a view illustrating how the garment is stuffed into the container-forming portion;

FIG. 4 is a view of the container-forming portion with the garment contained therewithin;

FIG. 5 is a view similar to FIG. 1 showing an alternative location for the container-forming portion;

FIG. 6 is a view of the container-forming portion of FIG. 5 with the garment contained therewithin, the container-forming portion having a generally spherical configuration;

FIG. 7 is a view similar to FIG. 6 showing a container-forming portion in an oblong generally football-shaped configuration;

FIG. 8 is a view similar to FIG. 6 showing a container-forming portion in a cylindric generally tire-shaped configuration;

FIG. 9 is a view showing a container-forming portion in a generally can-shaped configuration, and belt loops on the container-forming portion;

FIG. 10 is a partial elevational view of a garment similar to the one shown in FIG. 1 but with the container-forming portion being configured to resemble a face;

FIG. 11 is a view of a garment with a sleeve, a portion of which is eversible to form a container for the garment;

FIG. 12 is a view illustrating how the container-forming portion of FIG. 11 is everted;

FIG. 13 is a view of the garment of FIG. 11 stored in the everted container-forming portion;

Corresponding parts are designated by corresponding reference numerals in the several views of the drawings.

DESCRIPTION OF PREFERRED EMBODIMENTS

Figure 14:
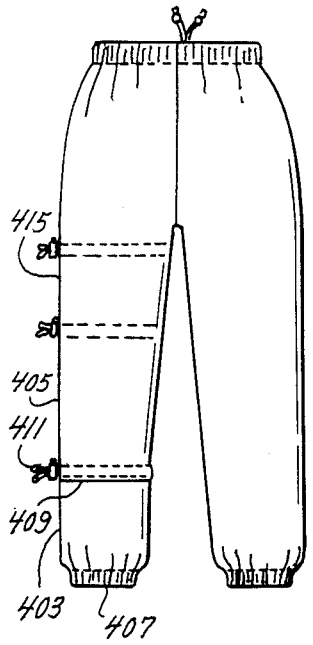
FIG. 14 is an elevational view of a garment with legs, a portion of one of the legs being adapted to form a container for the garment when the garment is not in use.

Referring now to the drawings, and first more particularly to FIG. 1, an article of flexible material is designated in its entirety by the reference numeral 1. As illustrated, the article is a garment in the nature of a jacket, but it will be understood that the present invention is not limited to any particular type of garment, or to garments generally for that matter. Rather this invention is applicable to any article having a tubular portion which is functional during normal use of the article and which is adapted to form a container for the article when the article is not in use.

The jacket 1 shown in FIG. 1 has a pair of sleeves 3, 5. In accordance with this invention, a portion 7 of one of these sleeves 3 is adapted to form a container for the jacket when the jacket is not in use. This container-forming portion 7 is illustrated as being located at the lower end of the sleeve 3 and as having first (lower) and second (upper) opposite ends, designated 9 and 11, respectively. The lower end 9 is at the arm opening of the sleeve (or, more specifically, the wrist opening) and the upper end 11 is spaced a distance above the wrist opening at about the mid-forearm area of the sleeve 3. The upper end 11 of the container-forming portion 7 defines a mouth 13 through which the jacket, when not in use, may be stuffed into the container-forming portion 7, as illustrated in FIG. 3. The wrist opening of the sleeve is restricted by elastic means comprising an elastic band 17 sewn into a hem 19 at the bottom of the sleeve. This elastic band 17 constitutes means carried by the garment for at least partially closing the lower end 9 of the container-forming portion 7. The upper end 11 of the container-forming portion may be at least partially closed by means of a drawcord 21 held within a hem 23 formed at the upper end of the portion. A slide lock 25 is provided for drawing the drawcord 21 to close the mouth 13 of the container-forming portion 7 after the garment has been stuffed inside. It will be understood that means other than a slide lock may be used to tighten the drawcord and maintain it tight (for example, a simple knot may suffice). The arrangement is such that, with the jacket stuffed in the container-forming portion 7 and both ends of the container-forming portion at least partially closed by the elastic band 17 and drawcord 21, the jacket 1 is releasably and securely held inside the container-forming portion. It will be noted in this regard that even though the elastic band 17 only partially closes the lower end 9 of the container-forming portion, the jacket stuffed inside will not escape through that end, due in part to the inherent resistance of the jacket to assume an inside-out configuration, which it would have to assume in order to move out through the wrist opening.

The container-forming portion 7 may have indicia 31 of any type (e.g., advertising, names, logos, and other markings) imprinted on its outside surface for display. It is significant to observe in this regard that this indicia 31 is visible not only during the normal course of use of the garment, but also when the garment is stuffed inside the container-forming portion 7, thus maximizing the amount of exposure of the indicia.

It will be understood that means other than an elastic band 17 and a drawcord 21 may be used to at least partially close the ends of the container-forming portion 7. For example, other means that might be used could include snaps, buttons, Velcro fasteners, slide fasteners (e.g., zippers), flaps or any device which restricts, constricts or otherwise reduces the size of the ends of the container-forming portion 7.

FIG. 5 shows a jacket 101 of alternative design, namely, one where the container-forming portion 103 is located between the upper and lower ends of one sleeve 105. It will be understood in this regard that the container-forming portion 103 could be located anywhere along either sleeve. As illustrated, the lower end 109 of the container-forming portion is spaced considerably above the wrist opening of the sleeve 105, in about the elbow area. The upper end 111 of the container-forming portion 103 is located immediately below the upper end of the sleeve. Drawcords 113, 115 in hems 117, 119 at the upper and lower ends of the container-forming portion 103 constitute means for at least partially closing the ends 109, 111 when the jacket has been stuffed inside the container-forming portion 103, as illustrated in FIG. 6. In this embodiment, the container-forming portion 103 is so dimensioned and configured that it is adapted to assume a generally spherical shape when the article is stuffed therein. While the drawcords 113, 115 depicted in solid lines in FIG. 6 are relatively short, they may be made longer (as depicted in phantom lines) so that they can be tied around the waist, for example, and thus function as a belt to enable the container-forming portion 103 to be readily carried.

One of the many advantages of the present invention is that the container-forming portion can be dimensioned and configured to assume many different shapes, some of which are illustrated in FIGS. 7–9. In FIG. 7, the container-forming portion 51 is generally oblong and in the general shape of a football, with drawcords 53, 55 at least partially closing the ends of the container-forming portion 51. Indeed, with proper imprinting, the container-forming portion could simulate a football. This shape can be obtained by increasing the length of the container-forming portion 51 (relative to the length of the container-forming portion 103 shown in FIG. 6) and by tapering the sleeve pattern toward the ends of the container-forming portion. In FIG. 8, the container-forming portion 61 is short, generally cylindric and could be imprinted to simulate a tire, for example. In FIG. 9, the container-forming portion 71 is longer, generally cylindric and could be imprinted to simulate a can, for example. Belt loop means comprising a pair of belt loops 73 may be attached (e.g., stitched) to the outside of the container-forming portion 71 for easy carrying. It will, of course, be understood that belt loops or the like could be used on all or any of the embodiments previously described, if so desired.

FIG. 10 illustrates a garment 201 having a sleeve 203, the lower portion 205 of which is adapted to form a container as previouslY described. In this embodiment, the container-forming portion 205 has means on the outside thereof giving the container-forming portion the appearance of a face 207. This means may comprise suitable markings on the garment material, parts attached to the garment material, Or any combination thereof. When the garment 201 is stuffed inside the container-forming portion 205, and the drawstring 209 is drawn tight, the container-forming portion will have the appearance of a head, which may have a clown face, for example, having appeal to children.

With proper imprinting, a container-forming portion of the present invention, when stuffed, may simulate a wide variety of articles, including (but not limited to) soccer balls, baseballs, tennis balls, golf balls, basketballs, volley balls, fruits, vegetables, bottles, doughnuts, and other items. If a drawcord is provided between the ends of the container-forming portion to restrict the size of the container-forming portion at that location, a shape like link sausages or dumbbells may be achieved.

FIG. 11 illustrates a garment 301 having a sleeve 303 with an elastic wristband (not shown) in a wrist hem 305 at the lower end of the sleeve. A drawcord 307 is received in a hem 309 on the inside of the sleeve 303. As illustrated in FIG. 12, the portion 311 of the sleeve 303 between the drawcord and the wristband is reversible to form a container for the garment. When portion 311 of the sleeve is everted by pulling the wrist hem 305 up on the outside of the sleeve, the wristband assumes a position above the drawcord 307 and the drawcord hem 309 assumes a position on the outside of the sleeve. In this configuration, the wrist hem 305 of the sleeve defines the mouth of the container-forming portion 311 through which the garment may be stuffed into the container-forming portion, as shown in FIGS. 12 and 13. Prior to stuffing the garment into the container-forming portion the drawcord 307 should be pulled tight. As mentioned previously, it will be understood that means other than an elastic band and a drawcord may be used for at least partially closing the ends of the container-forming portion 311. It will also be understood that this eversible feature is applicable to any tubular portion of garments or other articles. One of the advantages of an eversible container-forming portion is that indicia (such as that indicated at 313 in FIGS. 12 and 13) imprinted on the inside surface of the sleeve 305 will be visible only when the container-forming portion is functioning as a container as shown in FIG. 13. The indicia will not be visible during ordinary use of the garment or other article, which may be desireable in certain circumstances. Another advantage is that belt loops 315 on the container-forming portion are disposed on the inside of the sleeve 303 so they will not catch on anything when the garment is being worn.

FIG. 14 illustrates a garment 401 wherein the tubular portion used to form a container for the garment is a portion 403 of a leg 405 of the garment rather than a portion of a sleeve. As discussed above in connection with sleeves, the container-forming portion 403 may be located anywhere along the leg. The container-forming portion 403 shown in FIG. 14 extends from the leg opening up to a location spaced above the leg opening. The lower end 407 of the container-forming portion 403 is partially closed by an elastic band (not shown) and its upper end 409 may be closed by a drawcord 411. Alternatively, the container-forming portion could be located higher up on the leg, as illustrated at 415 in FIG. 14.

This invention is applicable to any type of garment having a tubular portion, such as T-shirts, sweat shirts, sweat suits, jackets, pants, coats, shirts, sweaters, leotards, sleepwear and lingerie. The invention is also applicable to other articles of flexible material having tubular parts, including bags, as described below.

Figure 16:
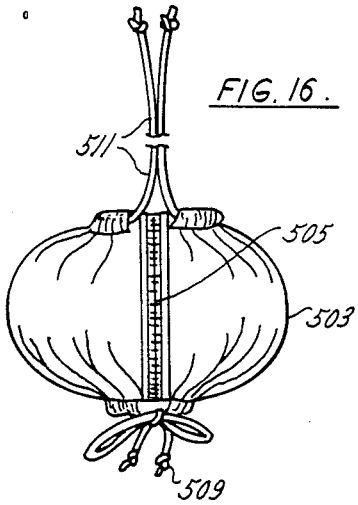
FIG. 16 is a view showing the duffel bag stuffed into the container-forming portion.
Figure 15:
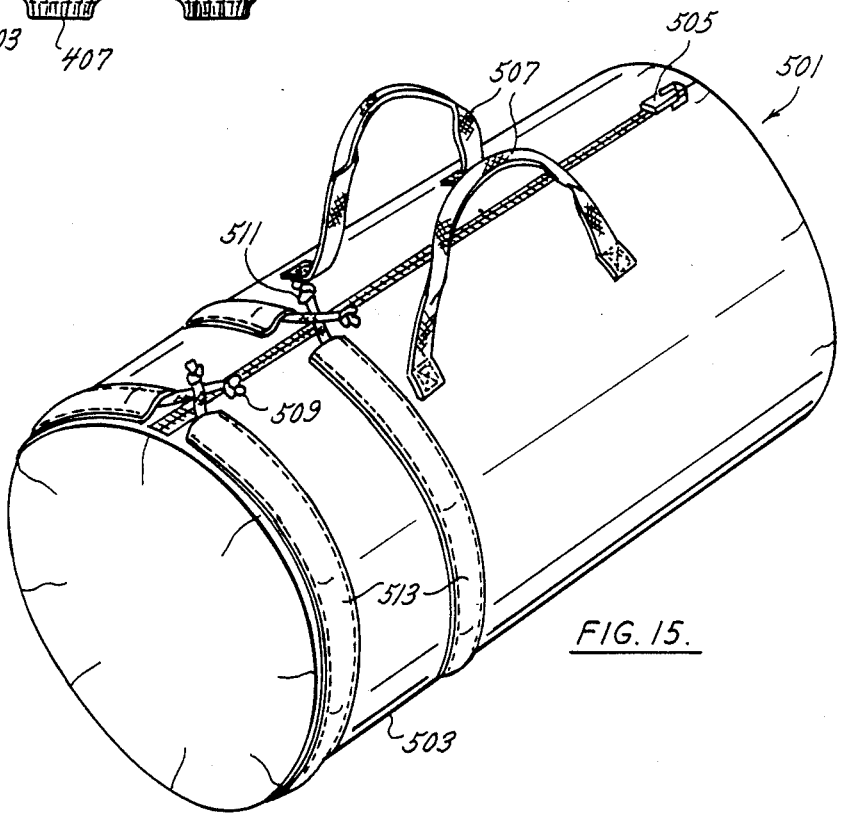
FIG. 15 is a perspective view of a duffel bag having a portion adapted to form a container for the bag when the bag is not being used as a duffel bag.

FIG. 15 illustrates a duffel bag, generally designated 501, incorporating the present invention. The bag is tubular in shape and has a tubular end portion 503 which functions as a part of the duffel bag in the ordinary use of the bag and also as a container for the bag when the bag is not in use. The bag has a zipper 505 for opening and closing the bag and a pair of handles 507 at the center of the bag for carrying the bag. A pair of drawcords 509, 511 are provided at opposite ends of the container-forming portion, one (509) encircling the bag at one end of the bag and the other (511) encircling the bag spaced a short distance from the first drawcord 509. Each drawcord 509, 511 is received in a tunnel formed by a strip 513 sewn along its edges circumferentially of the bag. When not in use, the duffel bag may be stored and/or transported by stuffing the bag into the mouth of the container-forming portion 503 defined essentially by drawcord 511. Once the bag has been stuffed inside the container-forming portion 503, the drawcords 509, 511 may be drawn tight and secured releasably to hold the bag in the container, as shown in FIG. 16.

It will be observed from the foregoing that the present invention may be incorporated into virtually any article of flexible material having a tubular portion which is functional during normal use of the article and which is adapted to form a container for the article when the article is not in use.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An article of flexible material having a tubular portion which is functional during normal use of the article and which is adapted to form a container for the article when the article is not in use, said tubular portion constituting a container-forming portion having first and second opposite open ends, at least one open end defining a mouth through which the article, when not in use, may be stuffed into said container-forming portion, first means carried by the article for at least partially closing the first open end of the container-forming portion, and second means carried by the article for at least partially closing the second open end of the container-forming portion whereby, with the article stuffed in said container-forming portion and both open ends of the container-forming portion at least partially closed, the article is releasably held in said container-forming portion.

2. An article as set forth in claim 1 wherein said article is a garment.

3. An article as set forth in claim 1 wherein said container-forming portion is so dimensioned and configured that it is adapted to assume a generally spherical shape when the article is stuffed therein.

4. An article as set forth in claim 1 wherein said container-forming portion is so dimensioned and configured that it is adapted to assume an oblong generally football shape when the article is stuffed therein.

5. An article as set forth in claim 1 wherein said container-forming portion is so dimensioned and configured that it is adapted to assume a short generally cylindric shape when the article is stuffed therein.

6. An article as set forth in claim 1 wherein said container-forming portion has means thereon for readily carrying said container-forming portion.

7. An article as set forth in claim 1 wherein said container-forming portion has indicia on the outside thereof.

8. An article as set forth in claim 1 wherein said container-forming portion has means on the outside thereof giving the container-forming portion the appearance of a face.

9. An article as set forth in claim 1 wherein said container-forming portion is eversible to form a container for the article.

10. An article as set forth in claim 2 wherein said garment has a leg and said container-forming portion comprises a portion of said leg.

11. An article as set forth in claim 6 wherein said means for carrying comprises belt-loop means for attachment of the container-forming portion to a belt.

12. An article as set forth in claim 9 wherein said container-forming portion has a surface having indicia thereon which is not visible when the article is in normal use but which is visible when the article is everted to function as a container.

13. An article as set forth in claim 9 wherein said container-forming portion has a surface having belt loops thereon which are not visible when the article is in normal use, but which are visible and functional when said containing-forming portion is everted to function as a container.

14. An article as set forth in claim 9 wherein said leg has an open lower end defining a leg opening and an upper end attached to the garment, said container-forming portion of the leg extending from a first location spaced above the leg opening to a second location spaced above the first location.

15. An article of flexible material having a tubular portion which is functional during normal use of the article and which is adapted to form a container for the article when the article is not in use, said tubular portion constituting a container-forming portion having first and second opposite ends, at least one end defining a mouth through which the article, when not in use, may be stuffed into said container-forming portion, first means carried by the article for at least partially closing the first end of the container-forming portion, and second means carried by the article for at least partially closing the second end of the container-forming portion whereby, with the article stuffed in said container-forming portion and both ends of the container-forming portion at least partially closed, the article is releasably held in said container-forming portion, said article comprising a garment having a sleeve, said container-forming portion comprising a portion of said sleeve.

16. An article as set forth in claim 15 wherein said sleeve has an open lower end defining an arm opening and wherein said container-forming portion extends up the sleeve from the arm opening, said first end of the container-forming portion being at the arm opening of the sleeve and said second end of the container-forming portion being spaced above the arm opening of the sleeve, said second end forming said mouth through which the garment is adapted to be stuffed into said container-forming portion.

17. An article as set forth in claim 15 wherein said sleeve has an open lower end defining an arm opening and an upper end attached to the garment, said container-forming portion of the sleeve extending from a first location spaced above the arm opening to a second location spaced above the first location.

18. An article as set forth in claim 16 wherein said first means comprises elastic means for restricting the size of the arm opening.

19. An article as set forth in claim 16 wherein said second means comprises drawcord means on the sleeve.

20. An article as set forth in claim 17 wherein said first means comprises drawcord means on the sleeve at said first location and drawcord means on the sleeve at said second location.

21. An article of flexible material having a tubular portion which is functional during normal use of the article and which is adapted to form a container for the article when the article is not in use, said tubular portion constituting a container-forming portion having first and second opposite ends, at least one end defining a mouth through which the article, when not in use, may be stuffed into said container-forming portion, first means carried by the article for at least partially closing the first end of the container-forming portion, and second means carried by the article for at least partially closing the second end of the container-forming portion whereby, with the article stuffed in said container-forming portion and both ends of the container-forming portion at least partially closed, the article is releasably held in said container-forming portion, said garment having a leg and said container-forming portion comprising a portion of said leg, said leg having an open lower end defining a leg opening and said container-forming portion extending up the leg from the leg opening, said first end of the container-forming portion being at the leg opening of the leg, and said second end of the container-forming portion being spaced above the leg opening of the leg, said second end forming said mouth through which the garment is adapted to be stuffed into said container-forming portion.

22. An article as set forth in claim 21 wherein said first means comprises elastic means for restricting the size of the leg opening.

23. An article as set forth in claim 21 wherein said second means comprises drawcord means on the leg.

24. An article of flexible material having a tubular portion which is functional during normal use of the article and which is adapted to form a container for the article when the article is not in use, said tubular portion constituting a container-forming portion having first and second opposite ends, at least one end defining a mouth through which the article, when not in use, may be stuffed into said container-forming portion, first means carried by the article for at least partially closing the first end of the container-forming portion, and second means carried by the article for at least partially closing the second end of the container-forming portion whereby, with the article stuffed in said container-forming portion and both ends of the container-forming portion at least partially closed, the article is releasably held in said container-forming portion, said article being a garment having a leg having an open lower end defining a leg opening and an upper end attached to the garment, said container-forming portion comprising a portion of the leg extending from a first location above the leg opening to a second location spaced above the first location, said first means comprising drawcord means on the leg at said first location and said second means comprising drawcord means on the leg at said second location.

25. An article of flexible material having a tubular portion which is functional during normal use of the article and which is adapted to form a container for the article when the article is not in use, said tubular portion constituting a container-forming portion having first and second opposite ends, at least one end defining a mouth through which the article, when not in use, may be stuffed into said container-forming portion, first means carried by the article for at least partially closing the first end of the container-forming portion, and second means carried by the article for at least partially closing the second end of the container-forming portion whereby, with the article stuffed in said container-forming portion and both ends of the container-forming portion at least partially closed, the article is releasably held in said container-forming portion, said first and second means comprising a pair of drawcords having lengths sufficient to be used as a belt for enabling the container-forming portion to be readily carried.

26. An article of flexible material having a tubular portion which is functional during normal use of the article and which is adapted to form a container for the article when the article is not in use, said tubular portion constituting a container-forming portion having first and second opposite ends, at least one end defining a mouth through which the article, when not in use, may be stuffed into said container-forming portion, first means carried by the article for at least partially closing the first end of the container-forming portion, and second means carried by the article for at least partially closing the second end of the container-forming portion whereby, with the article stuffed in said container-forming portion and both ends of the container-forming portion at least partially closed, the article is releasably held in said container-forming portion, said article comprising a bag, such as a duffel bag, and said first means and second means each comprising a drawcord.

* * * * *